US011391521B2

(12) United States Patent
Yatsuyanagi et al.

(10) Patent No.: US 11,391,521 B2
(45) Date of Patent: Jul. 19, 2022

(54) HEAT EXCHANGER, HEAT EXCHANGER UNIT, AND REFRIGERATION CYCLE APPARATUS

(71) Applicant: Mitsubishi Electric Corporation, Tokyo (JP)

(72) Inventors: Akira Yatsuyanagi, Tokyo (JP); Tsuyoshi Maeda, Tokyo (JP); Tomohiko Takahashi, Tokyo (JP); Yoshihide Asai, Tokyo (JP); Hidetomo Nakagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/049,056

(22) PCT Filed: Jun. 13, 2018

(86) PCT No.: PCT/JP2018/022576
§ 371 (c)(1),
(2) Date: Oct. 20, 2020

(87) PCT Pub. No.: WO2019/239520
PCT Pub. Date: Dec. 19, 2019

(65) Prior Publication Data
US 2021/0239409 A1 Aug. 5, 2021

(51) Int. Cl.
*F28D 1/04* (2006.01)
*F28F 1/32* (2006.01)

(52) U.S. Cl.
CPC ..... *F28F 1/32* (2013.01)

(58) Field of Classification Search
CPC ..... F28F 1/32
See application file for complete search history.

(56) References Cited

U.S. PATENT DOCUMENTS 2,915,296 A * 12/1959 Johnson ..... F28F 1/16 165/104.21
4,691,768 A * 9/1987 Obosu ..... F28F 1/325 165/151

(Continued)

FOREIGN PATENT DOCUMENTS

CN 107076526 A 8/2017
EP 2725311 A2 4/2014

(Continued)

OTHER PUBLICATIONS

Examination Report dated Oct. 25, 2021, issued in corresponding AU Patent Application No. 2018427607.

(Continued)

*Primary Examiner* — Davis D Hwu
(74) *Attorney, Agent, or Firm* — Posz Law Group, PLC

(57) ABSTRACT

A heat exchanger, a heat exchanger unit, and a refrigeration cycle apparatus are provided where heat exchange performance is improved, and drainage properties and resistance against frost formation are improved. A flat tube and a plurality of fins that are each a plate having a plate surface extending in a longitudinal direction and in a width direction orthogonal to the longitudinal direction are provided. The plate surface intersects a pipe axis of the flat tube, and the plurality of fins are arranged at an interval from one another. The plurality of fins each have a first spacer formed in the plate and maintaining the interval. The flat tube has a longitudinal axis of a section perpendicular to the pipe axis, and the longitudinal axis is inclined to the width direction by an inclination angle θ. The first spacer has a standing surface extending in a direction intersecting the plate surface.

17 Claims, 10 Drawing Sheets

(56) References Cited

U.S. PATENT DOCUMENTS

| | | | | |
|---|---|---|---|---|
| 2005/0056407 | A1* | 3/2005 | Oh | F28F 1/32 165/151 |
| 2007/0295492 | A1* | 12/2007 | Sharp | F28F 13/06 165/151 |
| 2013/0284416 | A1 | 10/2013 | Jindou et al. | |
| 2013/0299153 | A1 | 11/2013 | Jindou et al. | |
| 2018/0372429 | A1 | 12/2018 | Maeda et al. | |

FOREIGN PATENT DOCUMENTS

| | | | |
|---|---|---|---|
| JP | H07-091873 | A | 4/1995 |
| JP | 2008-170041 | A | 7/2008 |
| JP | 2012-163317 | A | 8/2012 |
| JP | 5177307 | B2 | 4/2013 |
| JP | 5337402 | B2 | 11/2013 |
| JP | 2014-035122 | A | 2/2014 |
| JP | 2014-156990 | A | 8/2014 |
| WO | 2017126019 | A1 | 7/2017 |

OTHER PUBLICATIONS

Office Action dated Dec. 1, 2021, issued in corresponding CN Patent Application No. 201880093507.2 (and English Machine Translation).

International Search Report of the International Searching Authority dated Aug. 14, 2018 for the corresponding International application No. PCT/JP2018/022576 (and English translation).

Indian Examination Report dated Apr. 19, 2021, issued in corresponding IN Patent Application No. 202027048660 (and English Machine Translation).

Extended European Search Report dated May 26, 2021, issued in corresponding European Patent Application No. 18922499.1.

Office Action dated Aug. 24, 2021, issued in corresponding JP Patent Application No. 2020-525009 (and English Machine Translation).

Office Action dated May 13, 2022 issued in corresponding CN patent application No. 201880093507.2 (and Machine English Translation).

* cited by examiner

Comparative Example

Comparative Example

HEAT EXCHANGER, HEAT EXCHANGER UNIT, AND REFRIGERATION CYCLE APPARATUS

CROSS REFERENCE TO RELATED APPLICATION

This application is a U.S. national stage application of PCT/JP2018/022576 filed on Jun. 13, 2018, the contents of which are incorporated herein by reference.

TECHNICAL FIELD

The present disclosure relates to a heat exchanger, a heat exchanger unit provided with the heat exchanger, and a refrigeration cycle apparatus, and particularly to a structure of a spacer that maintains an interval between fins installed on heat transfer tubes.

BACKGROUND ART

Some heat exchanger has been known that is provided with flat tubes, to improve heat exchange performance, that are each a heat transfer tube having a flat sectional shape with multiple holes. One example of such a heat exchanger is a heat exchanger where flat tubes are arranged at predetermined intervals from one another in the up-and-down direction with the direction of pipe axes extending in the lateral direction. In such a heat exchanger, plate-like fins are aligned in the direction of the pipe axes of the flat tubes, and heat is exchanged between air passing through between the fins and fluid flowing through the flat tubes.

Some fin has been known that is provided with a fin collar at the peripheral edge of a flat tube insertion portion. The fin collar ensures a separation between the fins by causing the distal end of the fin collar to be in contact with the next fin. In recent years, as the thickness of the flat tube has been reduced, the width of the flat tube insertion portion of the fin is small and hence, it is difficult to raise the fin collar, which is provided to the peripheral edge of the flat tube insertion portion, up to a predetermined height. To solve the problem, in Patent Literature 1, spacers are provided to each fin to maintain intervals between fins disposed next to each other, and each spacer is formed by bending a portion of the fin at a portion other than the peripheral edge of the flat tube insertion portion. The fin has an insertion region where the flat tube is inserted, and an extension region formed downwind of the insertion region. The spacers are formed in the insertion region and the extension region. The spacer in the extension region is formed right behind the spacer in the insertion region (see Patent Literature 1, for example).

CITATION LIST

Patent Literature

Patent Literature 1: Japanese Patent No. 5177307

SUMMARY OF INVENTION

Technical Problem

However, in the heat exchanger disclosed in Patent Literature 1, the spacer is formed by bending a portion of the fin, and the spacer is provided with a surface of the spacer directed in a direction of the flow of air passing through between the fins. A problem is consequently caused in that the area of an air passage between the fins decreases, so that ventilation properties of the heat exchanger are deteriorated. Further, in the case where the spacer is provided with the surface of the spacer extending along the direction of the flow of air, a problem lies in that, on the surface of the spacer, frost forms and stagnates and meltwater of frost stagnates, so that drainage properties and defrosting properties of the heat exchanger are reduced. Further, in the heat exchanger disclosed in Patent Literature 1, the flat tubes are disposed with the longitudinal direction of the sectional shape of each flat tube extending in the horizontal direction and hence, a problem lies in that water stagnates on the flat tube, and is not easily drained.

The present disclosure has been made to solve the above-mentioned problems, and it is an object of the present disclosure to provide a heat exchanger, a heat exchanger unit, and a refrigeration cycle apparatus where a reduction of drainage properties and ventilation properties is prevented, and an air passage is not easily clogged when frost forms.

Solution to Problem

A heat exchanger according to one embodiment of the present disclosure includes a flat tube and a plurality of fins that are each a plate having a plate surface extending in a longitudinal direction and in a width direction orthogonal to the longitudinal direction. The plate surface intersects a pipe axis of the flat tube, and the plurality of fins are arranged at an interval from one another. The plurality of fins each have a first spacer formed in the plate and maintaining the interval. The flat tube has a longitudinal axis of a section perpendicular to the pipe axis, and the longitudinal axis is inclined to the width direction by an inclination angle θ. The first spacer has a standing surface extending in a direction intersecting the plate surface, and the standing surface is inclined in a direction same as that of the inclination angle θ.

A heat exchanger unit according to another embodiment of the present disclosure includes the above-mentioned heat exchanger, and a fan configured to send air to the heat exchanger.

A refrigeration cycle apparatus according to still another embodiment of the present disclosure includes the above-mentioned heat exchanger unit. Advantageous Effects of Invention According to an embodiment of the present disclosure, with the above-mentioned configuration, the spacer appropriately maintains the interval between the fins. It is therefore possible to prevent the clogging of the air passage when frost forms, and drainage properties of meltwater are ensured during the defrosting process. Further, the spacer is inclined in the same direction as the flat tube, so that it is possible to prevent the blockage of the flow of air along the flat tube, and the reduction of ventilation properties between the fin and the flat tube. Resistance against frost and drainage properties of the heat exchanger, the heat exchanger unit, and the refrigeration cycle apparatus are therefore enhanced while heat exchange performance is maintained.

DESCRIPTION OF EMBODIMENTS

Figure 1:
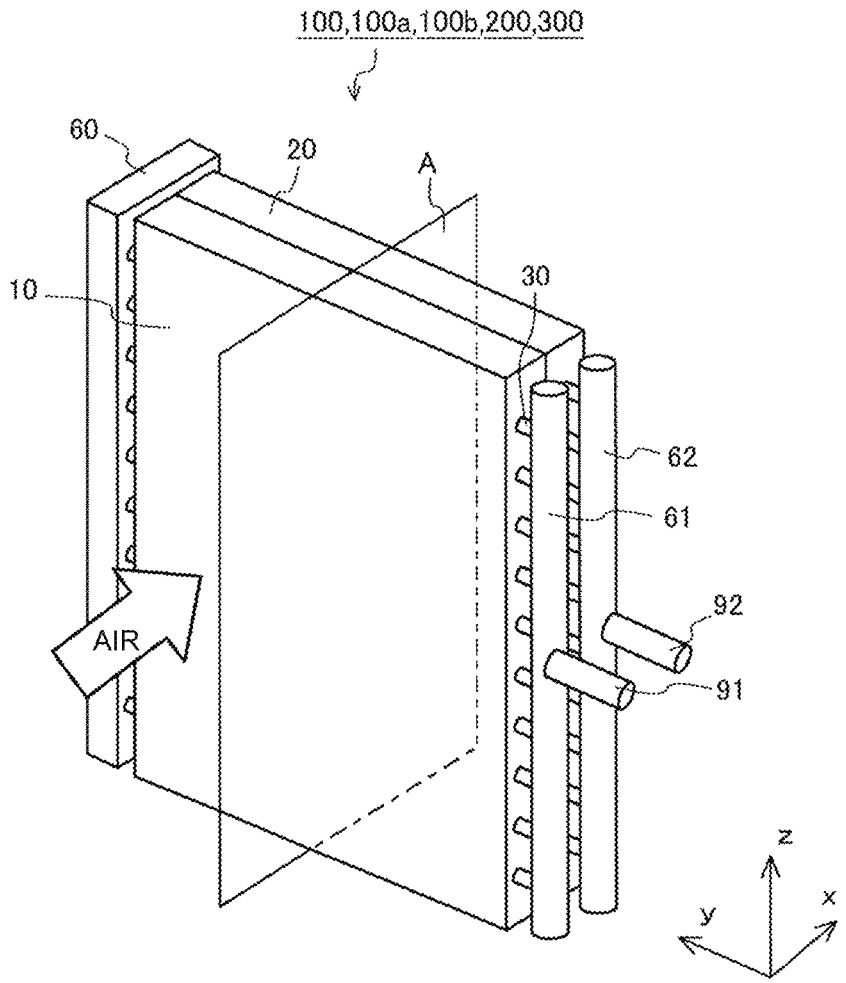
FIG. 1 is a perspective view showing a heat exchanger according to Embodiment 1.

Hereinafter, embodiments of a heat exchanger, a heat exchanger unit, and a refrigeration cycle apparatus are described. Hereinafter, the embodiments of the present disclosure are described with reference to drawings. In the drawings, components and portions given the same reference signs are the same or corresponding components and portions, and the reference signs are common in the entire specification. Further, forms of components described in the entire specification are merely examples, and the present disclosure is not limited to the description in the specification. In particular, the combination of the components is not limited to the combination in each embodiment, and components described in one embodiment may be applicable to another embodiment. Further, when it is not necessary to distinguish or specify a plurality of components or portions of the same kind that are, for example, differentiated by suffixes, the suffixes may be omitted. In the drawings, the relationship in size of the components and portions may differ from that of actual components and portions. It is noted that directions indicated by "x", "y", and "z" in the drawings indicate the same directions in the drawings.

Embodiment 1

Figure 2:
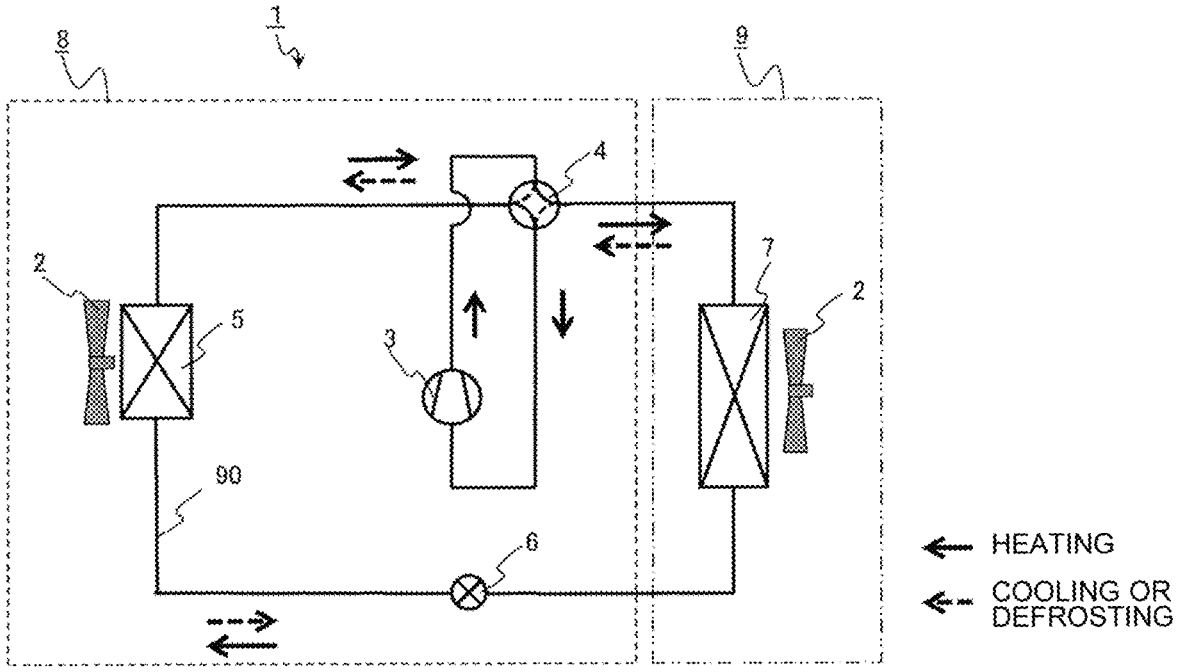
FIG. 2 is an explanatory view of a refrigeration cycle apparatus to which the heat exchanger according to Embodiment 1 is applied.

FIG. 1 is a perspective view showing a heat exchanger 100 according to Embodiment 1. FIG. 2 is an explanatory view of a refrigeration cycle apparatus 1 to which the heat exchanger 100 according to Embodiment 1 is applied. The heat exchanger 100 shown in FIG. 1 is a heat exchanger to be mounted on the refrigeration cycle apparatus 1, such as an air-conditioning apparatus and a refrigerator. In Embodiment 1, an air-conditioning apparatus is described as an example of the refrigeration cycle apparatus 1. The refrigeration cycle apparatus 1 has a configuration in which a compressor 3, a four-way valve 4, an outdoor heat exchanger 5, an expansion device 6, and an indoor heat exchanger 7 are connected by a refrigerant pipe 90 to form a refrigerant circuit. In the refrigeration cycle apparatus 1, refrigerant flows through the refrigerant pipe 90. By switching the flows of the refrigerant by the four-way valve 4, the operation of the refrigeration cycle apparatus 1 is switched to one of a heating operation, a refrigerating operation, and a defrosting operation.

The outdoor heat exchanger 5 is mounted on an outdoor unit 8, the indoor heat exchanger 7 is mounted on an indoor unit 9, and a fan 2 is disposed in the vicinity of each of the outdoor heat exchanger 5 and the indoor heat exchanger 7. In the outdoor unit 8, the fan 2 sends outside air into the outdoor heat exchanger 5 to exchange heat between the outside air and refrigerant. In the indoor unit 9, the fan 2 sends indoor air into the indoor heat exchanger 7 to exchange heat between the indoor air and refrigerant, so that the temperature of the indoor air is conditioned. Further, in the refrigeration cycle apparatus 1, the heat exchanger 100 may be used as the outdoor heat exchanger 5, mounted on the outdoor unit 8, or as the indoor heat exchanger 7, mounted on the indoor unit 9, and the heat exchanger 100 is used as a condenser or an evaporator. In the specification, a unit, such as the outdoor unit 8 and the indoor unit 9, on which the heat exchanger 100 is mounted is particularly referred to as "heat exchanger unit".

The heat exchanger 100 shown in FIG. 1 includes two heat exchange parts 10, 20. The heat exchange parts 10, 20 are arranged in series along the x direction shown in FIG. 1. The x direction is a direction perpendicular to a direction along which flat tubes 30 of the heat exchange part 10 are arranged in parallel and to a direction along which the pipe axes of the flat tubes 30 extend. In Embodiment 1, air flows into the heat exchanger 100 along the x direction. The heat exchange parts 10, 20 are consequently arranged in series along a direction along which air flows through the heat exchanger 100. The first heat exchange part 10 is disposed upwind, and the second heat exchange part 20 is disposed downwind. Headers 60, 61 are disposed at both ends of the heat exchange part 10, and the header 60 and the header 61 are connected with each other by the flat tubes 30. The header 60 and a header 62 are disposed at both ends of the heat exchange part 20, and the header 60 and the header 62 are connected with each other by the flat tubes 30. Refrigerant flowing into the header 61 from a refrigerant pipe 91 passes through the heat exchange part 10, flows into the heat exchange part 20 through the header 60, and flows out to a refrigerant pipe 92 from the header 62. The heat exchange part 10 and the heat exchange part 20 may have the same structure, or may have different structures.

Figure 3:
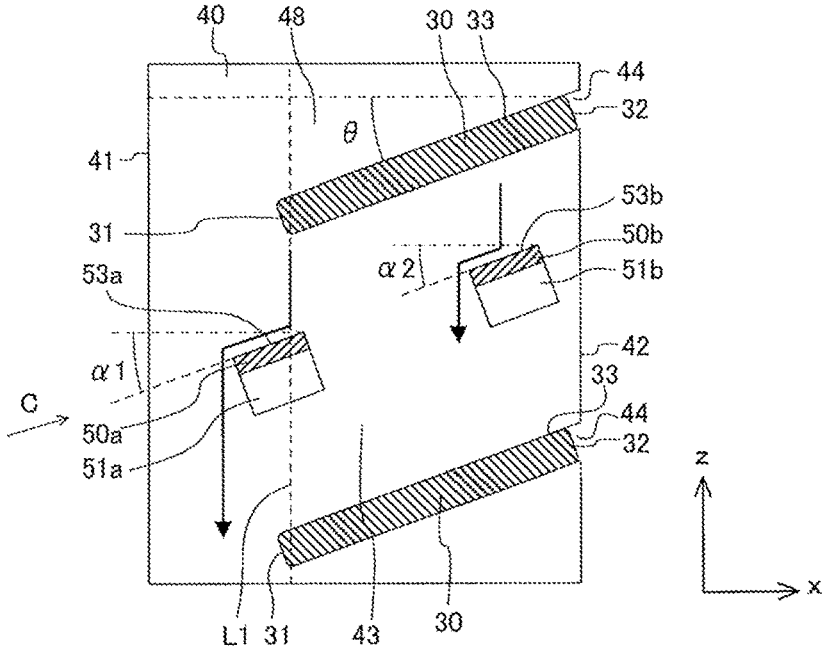
FIG. 3 is an explanatory view of the sectional structure of the heat exchanger shown in FIG. 1.

FIG. 3 is an explanatory view of the sectional structure of the heat exchanger 100 shown in FIG. 1. FIG. 3 is an explanatory view showing a portion of a section A of the heat exchange part 10 of the heat exchanger 100 shown in FIG. 1 as the portion is viewed from the lateral direction, and the section A is perpendicular to the y axis. The heat exchange part 10 has a configuration in which the plurality of flat tubes 30 are arranged in parallel in the z direction with the pipe axes of the flat tubes 30 extending in the y direction. Refrigerant flows through the flat tubes 30, so that heat is exchanged between air sent into the heat exchanger 100 and the refrigerant flowing through the flat tubes 30. Further, the heat exchange part 10 has a configuration in which fins 40 are attached to the flat tubes 30 with a plate surface 48 of each fin 40, which is a plate, intersecting the pipe axes of the flat tubes 30. The fin 40 has a rectangular shape having the longitudinal direction of the fin 40 extending in a direction along which the flat tubes 30 are arranged in parallel. In other words, the fin 40 is provided with the longitudinal direction of the fin 40 extending along the z direction. A first end edge 41, which is one end edge in the x direction, of the fin 40 is positioned upwind, and a second end edge 42, which is the other end edge, of the fin 40 is positioned downwind. Cut-out portions 44 are formed at the second end edge 42. The flat tubes 30 are fitted in these cut-out portions 44. The width direction of the fin 40 means a direction orthogonal to the longitudinal direction of the fin 40, and aligns with the x direction. In FIG. 3, two flat tubes 30 are shown. These two flat tubes 30 disposed next to each other along the longitudinal direction of the fin 40 may be referred to as "first flat tube" and "second flat tube".

Each flat tube 30 has the longitudinal axis of a section inclined to the width direction of the fin 40 by an inclination angle θ. A first end portion 31 positioned closer to the first end edge 41 of the fin 40 than is a second end portion 32 is positioned lower than is the second end portion 32 positioned closer to the second end edge 42 than is the first end portion 31. Each cut-out portion 44 formed at the second end edge 42 of the fin 40 is also inclined to the width direction of the fin 40 by the inclination angle θ.

The plurality of fins 40 are arranged along a direction along which the pipe axes of the flat tubes 30 extend. The fins 40 disposed next to each other are disposed with a predetermined gap between the fins 40 so that air is allowed to pass through between the fins 40. To ensure an interval between the fins 40 disposed next to each other, a first spacer 50*a* and a second spacer 50*b* are formed on the fins 40. Hereinafter, the first spacer 50*a* and the second spacer 50*b* may be collectively referred to as "spacer 50". The spacer 50 is formed by bending a portion of the fin 40, which is a plate, and the spacer 50 is erected in a direction intersecting the plate surface 48.

Figure 4:
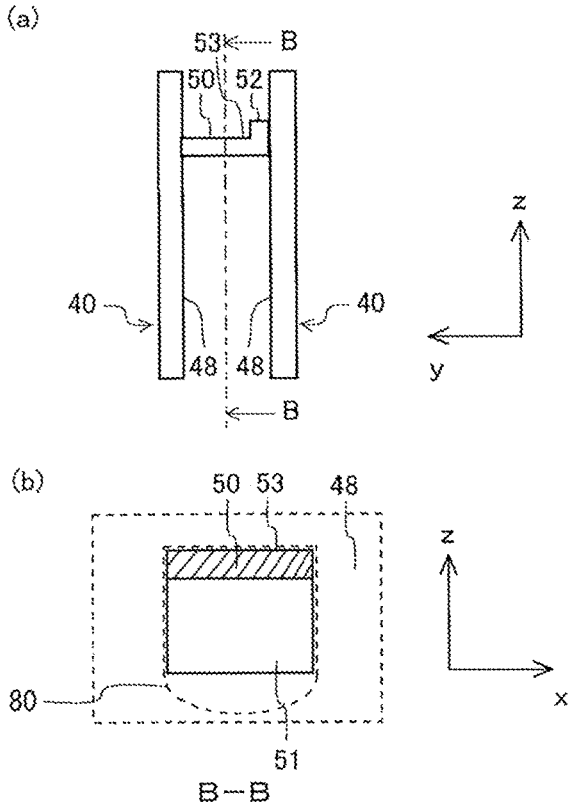
FIG. 4 includes enlarged views of a spacer provided to fins of the heat exchanger according to Embodiment 1.

FIG. 4 includes enlarged views of the spacer 50 provided to the fins 40 of the heat exchanger 100 according to Embodiment 1. FIG. 4(*a*) is an enlarged view as the spacer 50 is viewed from the direction illustrated by an arrow C in FIG. 3, and is an enlarged view as the spacer 50 is viewed from a direction parallel to the plate surfaces 48 of the fins 40 and parallel to a standing surface 53 of the spacer 50. FIG. 4(*b*) is an explanatory view of the structure of the spacer 50 as the spacer 50 is viewed from a direction perpendicular to a section taken along B-B in FIG. 4(*a*). The spacer 50 is erected toward the next fin 40, and the distal end of the spacer 50 is in contact with the plate surface 48 of the next fin 40. The distal end of the spacer 50 is bent to form a contact portion 52. In Embodiment 1, the standing surface 53 of the spacer 50 extends substantially perpendicular to the plate surface 48 of the fin 40. The spacer 50 is formed by bending a portion of the fin 40 in a direction intersecting the plate surface 48. An opening port 51 is formed adjacent to the spacer 50 in the opposite direction of the z direction. An opening port 51*a* adjacent to the first spacer 50*a* may be referred to as "first opening port", and an opening port 51*b* adjacent to the second spacer 50*b* may be referred to as "second opening port". Further, a standing surface 53*a* of the first spacer 50*a* may be referred to as "first standing surface", and a standing surface 53*b* of the second spacer 50*b* may be referred to as "second standing surface".

Figure 5:
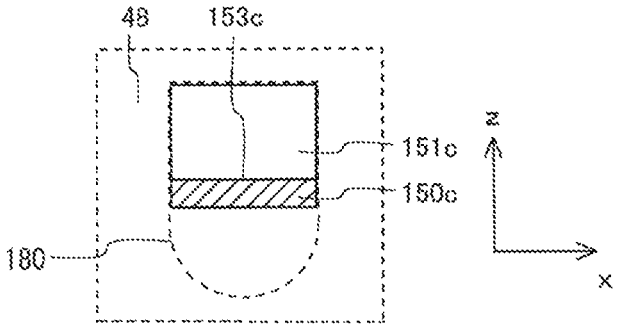
FIG. 5 is an explanatory view of a spacer that is a comparative example of the spacer formed on the fins of the heat exchanger according to Embodiment 1.

FIG. 5 is an explanatory view of a spacer 150*c* that is a comparative example of the spacer 50 formed on the fins 40 of the heat exchanger 100 according to Embodiment 1. FIG. 5 is an explanatory view as the spacer 150*c* is viewed in the same direction as FIG. 4(*b*). The spacer 150*c* of the comparative example is formed by bending a portion of a fin 140 in the opposite direction of the z direction in FIG. 5. In other words, when the heat exchanger 100 is installed with the opposite direction of the z direction in FIG. 5 aligning with the direction of gravity, the spacer 150*c* is formed by bending the portion of the fin 140 in the direction of gravity. A standing surface 153*c* is formed substantially perpendicular to the plate surface 48. In this case, an opening port 151*c* is formed over the spacer 150*c*. When condensation water or meltwater of frost flows down to the spacer 150*c*, not only water stays on the standing surface 153*c*, but also water adheres to the edge of the opening port 151*c* because of capillarity. Further, water drops also adhere to a portion under the spacer 150*c* in such a manner that the water drops hang from the portion under the spacer 150*c*, so that the spacer 150*c* and the opening port 151*c* maintain water in a region surrounded by a dotted line 180 in FIG. 5. In contrast, water drops adhere to the spacer 50 and the opening port 51 according to Embodiment 1 in such a manner that the water drops hang from a portion under the spacer 50 as shown by a dotted line 80 in FIG. 4(*b*). The amount of water maintained at the spacer 50 and the opening port 51 is consequently small compared with that maintained at the spacer 150*c* and the opening port 151*c* of the comparative example. In other words, the spacer 50 and the opening port 51 according to Embodiment 1 maintains less amount of water and has higher drainage properties compared with the spacer 150*c* and the opening port 151*c* of the comparative example.

As shown in FIG. 3, in Embodiment 1, the spacer 50 is provided at two positions between two flat tubes 30 arranged in the longitudinal direction of the fin 40. The spacers 50 are aligned in the width direction of the fin 40, and are disposed in such a manner that a stable interval between the fins 40 is ensured. The first spacer 50*a* is disposed close to the first end edge 41 of the fin 40, and is positioned on a first imaginary line L1 connecting lower ends of the first end portions 31 of the flat tubes 30 aligned in the up-and-down direction.

When the fin 40 is viewed in the y direction, that is, when the fin 40 is viewed in a direction perpendicular to the plate surface 48, the standing surface 53*a* of the first spacer 50*a* is inclined in the direction same as that of the inclination angle θ of the flat tube 30, and the standing surface 53*a* is inclined by an inclination angle α1. Each of the inclination angle θ and the inclination angle α1 is an angle by which the flat tube 30 or the standing surface 53*a* is inclined to the x axis on a section perpendicular to the pipe axes of the flat tubes 30 and, in other words, is an angle by which the flat tube 30 or the standing surface 53*a* is inclined to a straight line horizontal to the width direction of the fin 40. The inclination angle α1 of the standing surface 53*a* of the first spacer 50*a* is set to satisfy a mathematical formula of $0<\alpha 1\leq\theta$.

The second spacer 50*b* is formed on the fin 40 in an intermediate region 43, which is a region between the cut-out portions 44 into which the flat tubes 30 are inserted. The standing surface 53*b* of the second spacer 50*b* is also inclined in the same direction as the direction in which the flat tube 30 is inclined in the same manner as the standing surface 53*b* of the first spacer 50*a*. The second spacer 50*b* has an inclination angle α2, and is set to satisfy a mathematical formula of $0<\alpha 2\leq\theta$. The inclination angle α2 is also an angle by which the standing surface 53*b* is inclined to the x axis on the section perpendicular to the pipe axes of the flat tubes 30 and, in other words, is an angle by which the standing surface 53*b* is inclined to a straight line horizontal to the width direction of the fin 40.

Modification of Spacer 50

Figure 6:
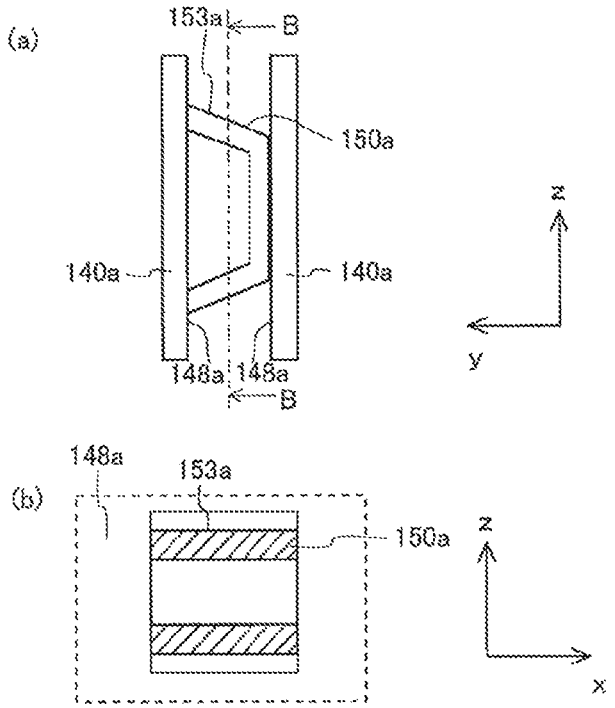
FIG. 6 includes explanatory views of a spacer that is a modification of the spacer formed on the fins of the heat exchanger according to Embodiment 1.

FIG. 6 includes explanatory views of a spacer 150*a* that is a modification of the spacer 50 formed on the fins 40 of the heat exchanger 100 according to Embodiment 1. FIG. 6(*a*) corresponds to FIG. 4(*a*), and FIG. 6(*b*) corresponds to FIG. 4(*b*). Each of the first spacer 50*a* and the second spacer 50*b* provided to the fins 40 of the heat exchanger 100 according to Embodiment 1 may have the structure of the spacer 150*a* as shown in FIG. 6, for example. The spacer 150*a* is formed in such a manner that two slits are formed in a plate surface 148*a* of the fin 140, and a portion between these slits is caused to protrude from the plate surface 148*a*. The spacer 150*a* is consequently connected with the plate surface 148*a* at two positions. In FIG. 6, an upper surface of the spacer 150*a* is a standing surface 153*a*. In the same manner as the standing surface 53 of the spacer 50, the standing surface 153*a* is inclined in the same direction as the flat tube 30 in the heat exchanger 100 when the standing surface 153*a* is viewed in they direction.

Figure 7:
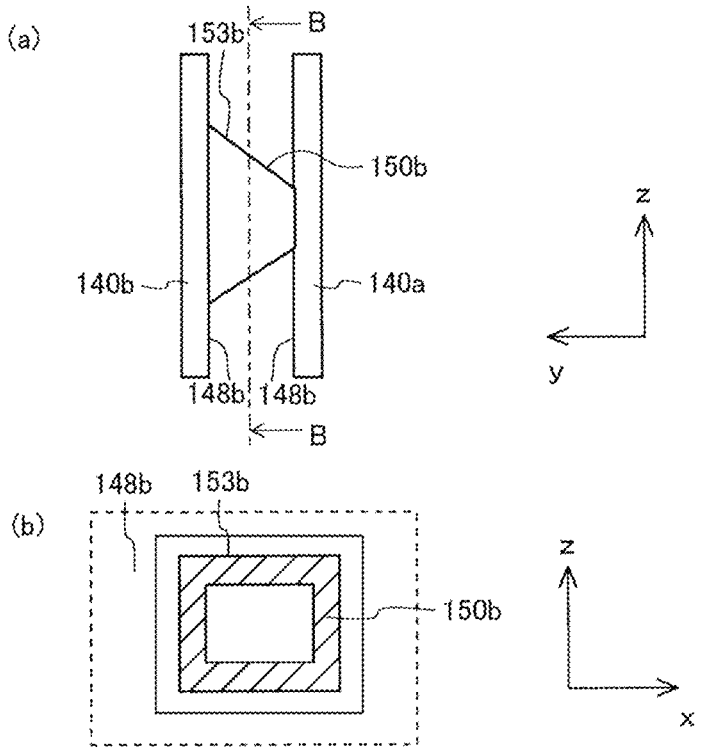
FIG. 7 includes explanatory views of a spacer that is a modification of the spacer formed on the fins of the heat exchanger according to Embodiment 1.

FIG. 7 includes explanatory views of a spacer 150*b* that is a modification of the spacer 50 formed on the fins 40 of the heat exchanger 100 according to Embodiment 1. FIG. 7(*a*) corresponds to FIG. 4(*a*), and FIG. 7(*b*) corresponds to FIG. 4(*b*). The spacer 150*b* is formed in such a manner that the spacer 150*b* is caused to protrude from a plate surface 148*b* of the fin 140 in a rectangular shape. In FIG. 7, an upper surface of the spacer 150*b* is a standing surface 153*b*. In the same manner as the standing surface 53 of the spacer 50, the standing surface 153*b* is inclined in the same direction as the flat tube 30 in the heat exchanger 100 when the standing surface 153*b* is viewed from they direction.

Draining Action of Heat Exchanger 100

Advantageous effects of the heat exchanger 100 according to Embodiment 1 are described below. To facilitate understanding of drainage properties of the heat exchanger 100 according to Embodiment 1, hereinafter, the description is made for the operation of the heat exchanger 100 when the heat exchanger 100 is operated as an evaporator under the condition that outside air has a low temperature. Subsequently, the configuration of a heat exchanger 1100 of a comparative example is described, and the draining action of the heat exchanger 100 according to Embodiment 1 is then described.

Figure 8:
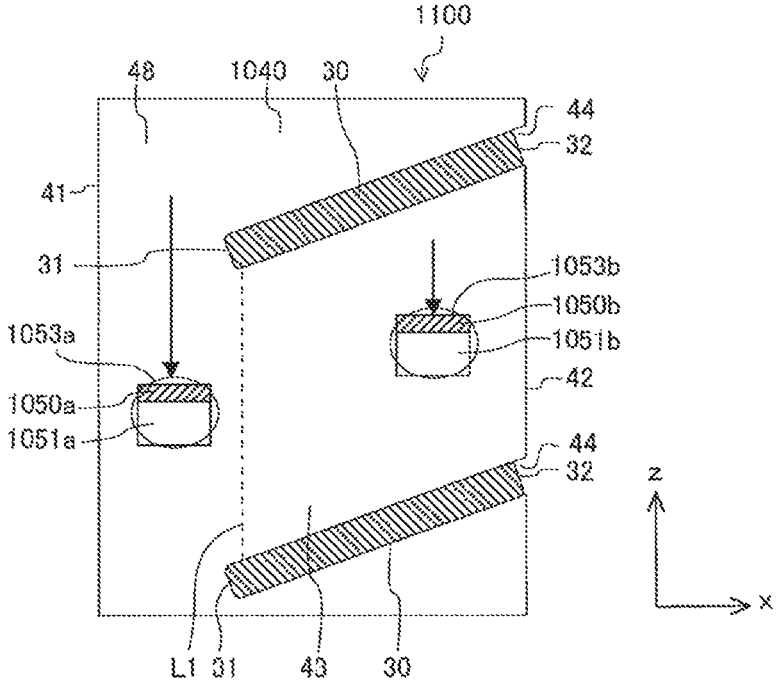
FIG. 8 is an explanatory view of the sectional structure of a heat exchanger that is a comparative example of the fin of the heat exchanger according to Embodiment 1.

FIG. 8 is an explanatory view of the sectional structure of the heat exchanger 1100 that is the comparative example of the fin 40 of the heat exchanger 100 according to Embodiment 1. In the same manner as FIG. 3, FIG. 8 shows a section perpendicular to the pipe axes of the flat tubes 30. Also in a fin 1040 of the heat exchanger 1100 of the comparative example, spacers 1050*a*, 1050*b* are formed in a region between the flat tubes 30. Each of the spacers 1050*a*, 1050*b* is formed by bending a portion of the fin 1040, and standing surfaces 1053*a*, 1053*b* are formed to be horizontal to the width direction of the fin 1040. Further, opening ports 1051*a*, 1051*b* are respectively formed below and adjacently to the spacers 1050*a*, 1050*b*.

During the operation of the refrigeration cycle apparatus 1, condensation water or meltwater of frost flows down onto the fin 1040 from above. In such a case, water flows down also onto the standing surfaces 1053*a*, 1053*b* of the spacers 1050*a*, 1050*b*. In the heat exchanger 1100 of the comparative example, the spacers 1050*a*, 1050*b* are formed to be horizontal, so that water stagnates on the standing surfaces 1053*a*, 1053*b*, and is not drained. Water on the standing surfaces 1053*a*, 1053*b* is consequently frozen, and a frozen portion expands using the frozen water as a base point and thus becomes a cause of clogging of an air passage, or breakage of the heat exchanger 1100.

In contrast, in the heat exchanger 100 according to Embodiment 1, the first spacer 50*a* and the second spacer 50*b* are inclined, so that water on the standing surfaces 53*a*, 53*b* is rapidly drained by gravity and flows downward. With such a configuration, in the heat exchanger 100, an appropriate gap is ensured between the fins 40 disposed next to each other, and water flowing down onto the standing surface 53 of the first spacer 50*a* does not stagnate. The heat exchanger 100 consequently has high drainage properties, and has no clogging of an air passage between the fins 40 and hence, no possibility remains that heat exchange performance of the heat exchanger 100 is impaired.

To prevent ventilation resistance in the heat exchanger 100, and to reduce the amount of refrigerant filled in the refrigeration cycle apparatus 1 for lessening an effect on global warming, the transverse axis of the flat tube 30 is set to have a small value, that is, the thickness of the flat tube 30 is reduced. With such a reduction in thickness, in providing a fin collar to the peripheral edge of the cut-out portion 44 for appropriately ensuring intervals between the fins 40, the cut-out portion 44 into which the fin 40 is to be inserted has a small width and hence, it is difficult to raise the fin collar, which is provided to the peripheral edge of the cut-out portion 44, up to a predetermined height. However, by providing the spacer 50 to the fin 40 as in the case of the heat exchanger 100 according to Embodiment 1, it is possible to appropriately ensure intervals between the fins 40.

Modification of First Spacer

Figure 9:
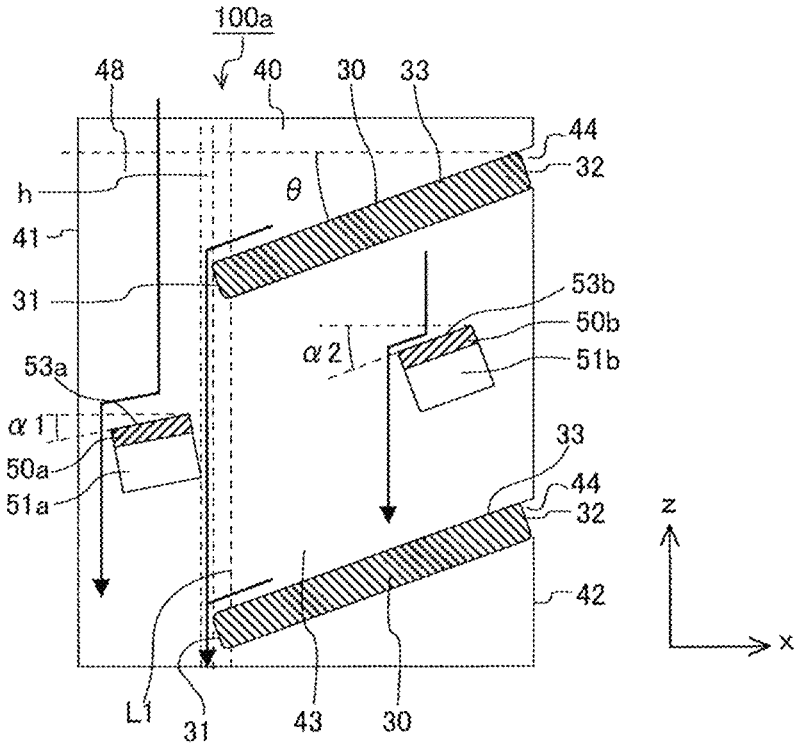
FIG. 9 is an explanatory view of the sectional structure of a heat exchanger that is a modification of the heat exchanger according to Embodiment 1.

FIG. 9 is an explanatory view of the sectional structure of a heat exchanger 100*a* that is a modification of the heat exchanger 100 according to Embodiment 1. In the heat exchanger 100*a* of the modification, the first spacer 50*a* is disposed in a region close to the first end edge 41 of the fin 40, and no cut-out portion 44 is provided at the first end edge 41. In other words, the first spacer 50*a*, disposed close to the first end edge 41 of the fin 40, is disposed in such a manner that the first spacer 50*a* at least does not overlap with the first imaginary line L1 connecting the first end portions 31 of the flat tubes 30 aligned in the z direction.

In the heat exchanger 100*a* of the modification, the first spacer 50*a* is disposed away from the first imaginary line L1 by 1 mm or more, for example. By disposing the first spacer 50*a* as described above, when water on the flat tube 30 flows down from the first end portion 31 of the flat tube 30, water flows through a drainage region h formed between the first spacer 50*a* and the first end portions 31 of the flat tubes 30. In the case where the direction of gravity aligns with the longitudinal direction of the fin 40, no object that blocks the flow of water is disposed in the drainage region h and hence, the heat exchanger 100*a* of the modification has further improved drainage properties compared with the heat exchanger 100.

Figure 10:
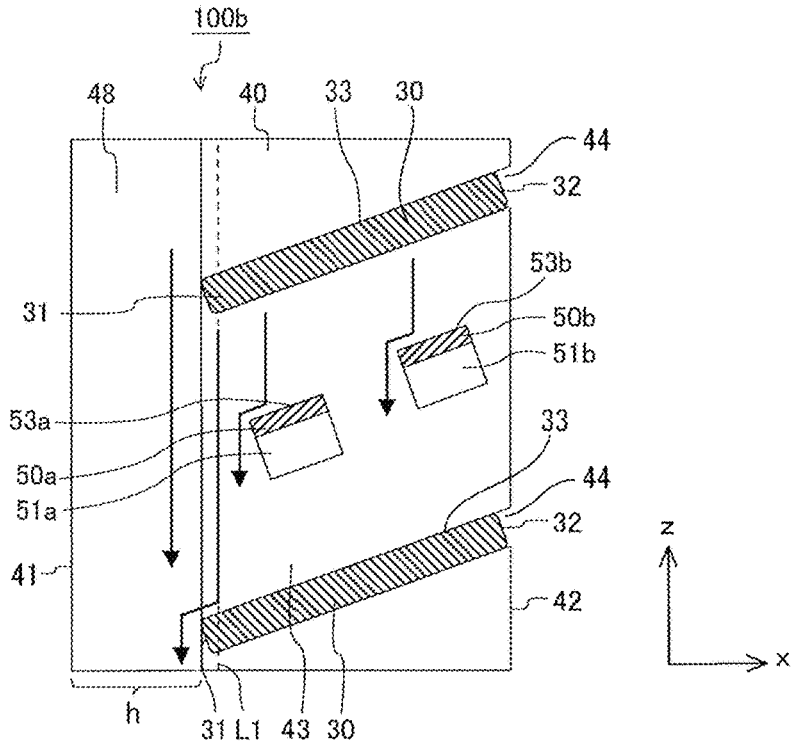
FIG. 10 is an explanatory view of the sectional structure of a heat exchanger that is a modification of the heat exchanger according to Embodiment 1.

FIG. 10 is an explanatory view of the sectional structure of a heat exchanger 100*b* that is a modification of the heat exchanger 100 according to Embodiment 1. In the heat exchanger 100*b* of the modification, the first spacer 50*a* is disposed in the intermediate region 43 of the fin 40, and the intermediate region 43 is disposed between two cut-out portions 44 disposed next to each other. In other words, the first spacer 50*a*, disposed close to the first end edge 41 of the fin 40, is disposed in the intermediate region 43 in such a manner that the first spacer 50*a* does not overlap with the first imaginary line L1 connecting the first end portions 31 of the flat tubes 30 aligned in the z direction in FIG. 10.

In the heat exchanger 100*b* of the modification, the first spacer 50*a* is not disposed in the region close to the first end edge 41 of the fin 40, and no cut-out portion 44 is provided at the first end edge 41. No possibility consequently remains that the first spacer 50*a* blocks the flow of water from above shown in FIG. 10. Further, when water staying on an upper surface 33 of the flat tube 30 flows down from the first end portion 31 of the flat tube 30, the water flows through the drainage region h positioned closer to the first end edge 41 than the first end portion 31 of the flat tube 30. In the case where the direction of gravity aligns with the longitudinal direction of the fin 40, that is, the direction of gravity aligns with the z direction in FIG. 10, no object that blocks the flow of water is disposed in the drainage region h and hence, the heat exchanger 100*b* of the modification has further improved drainage properties compared with the heat exchanger 100.

Figure 11:
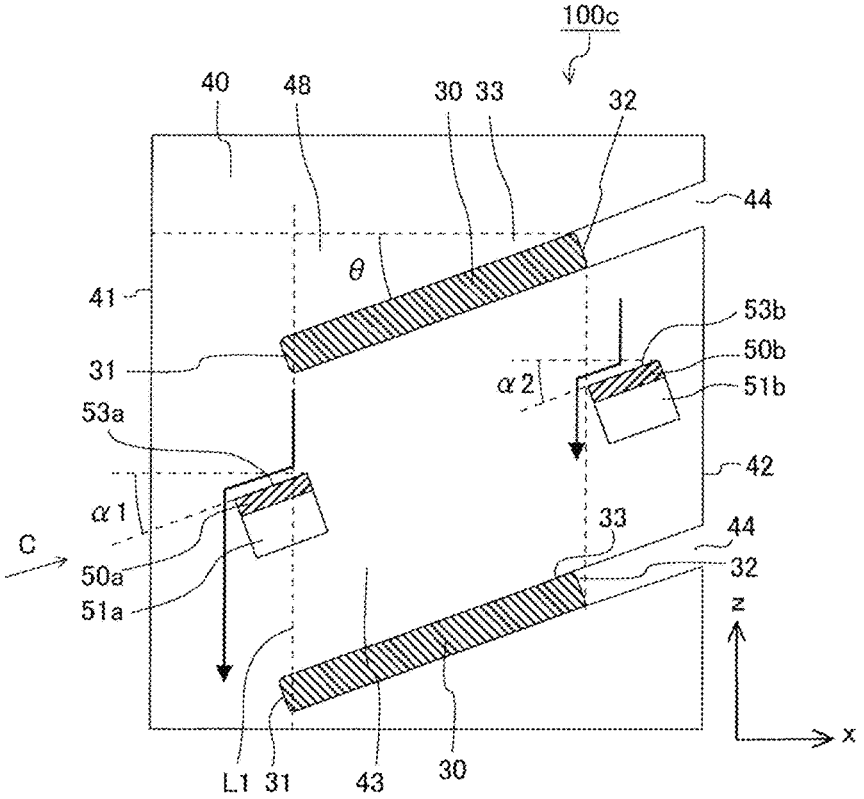
FIG. 11 is an explanatory view of the sectional structure of a heat exchanger that is a modification of the heat exchanger according to Embodiment 1.

FIG. 11 is an explanatory view of the sectional structure of a heat exchanger 100*c* that is a modification of the heat exchanger 100 according to Embodiment 1. The heat exchanger 100*c* of the modification is obtained by causing the fin 40 to extend farther in the downwind direction than the second end portions 32 of the flat tubes 30. As the shape of the fin 40 is caused to extend in the downwind direction, the cut-out portions 44 are also formed to extend in the downwind direction. Nothing is disposed in a region of the cut-out portion 44 at a portion close to the second end edge 42. In the heat exchanger 100 according to Embodiment 1, the second end edge 42 and the second end portions 32 of the flat tubes 30 are disposed at substantially the same position in the x direction. In contrast, in the heat exchanger 100*c* of the modification, the second end edge 42 of the fin 40 is positioned away from the second end portions 32 of the flat tubes 30 in the x direction. Further, in the intermediate region 43, the second spacer 50*b* is disposed in a region between the second end portions 32 and the second end edge 42 of the fin 40, and each second end portion 32 is the end portion of the flat tube 30 disposed downwind in the width direction of the fin 40. By disposing the second spacer 50*b* further downstream than is the flat tube 30, it is possible to prevent the reduction of heat exchange performance of the heat exchanger 100*c* caused by the provision of the second spacer 50*b*.

In the heat exchanger 100, 100*a*, 100*b*, 100*c* according to Embodiment 1, the second spacer 50*b* is formed in the intermediate region 43 of the fin 40. However, as long as intervals between the fins 40 are appropriately ensured, the second spacer 50*b* may not be provided. Further, it is not always necessary to provide the spacer 50 in every space provided between the flat tubes 30, and the positions where spacers 50 are installed may be suitably changed. In addition to the above, it is not always necessary to provide the first spacer 50*a* and the second spacer 50*b* as a set, and only either one of the first spacer 50*a* or the second spacer 50*b* may be provided at some positions.

Ventilation Properties of Heat Exchanger 100

Figure 12:
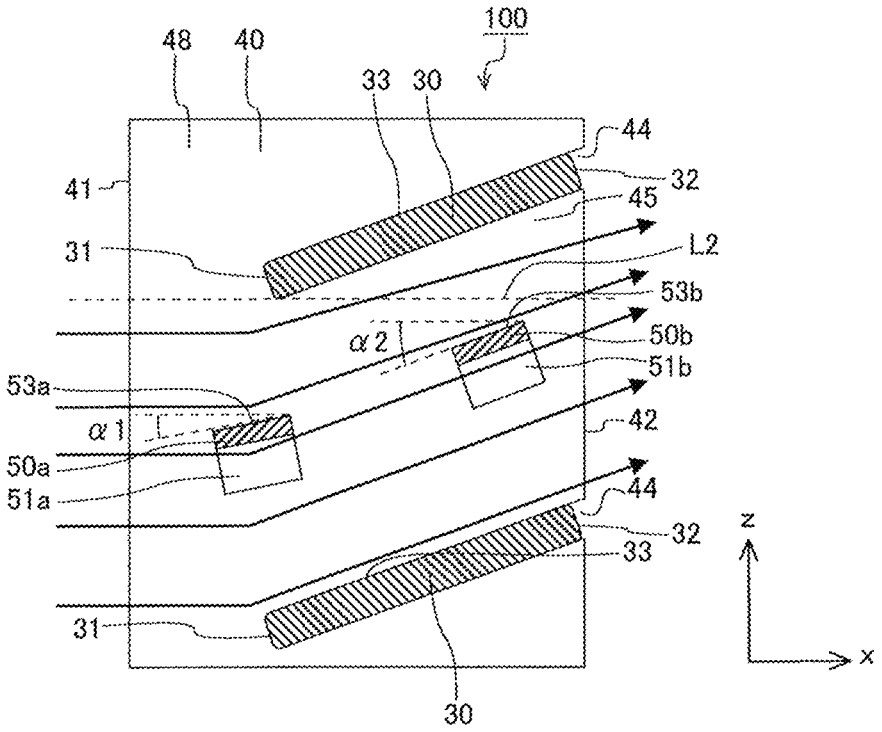
FIG. 12 is an explanatory view of the flow of air passing through the heat exchanger according to Embodiment 1.

FIG. 12 is an explanatory view of the flow of air passing through the heat exchanger 100 according to Embodiment 1. FIG. 12 shows a state where the first end edge 41 of the fin 40 of the heat exchanger 100 is disposed upwind. In the heat exchanger 100, the first spacer 50*a* and the second spacer 50*b* are provided, so that intervals between the fins 40 are appropriately maintained. Air consequently passes through between the fins 40 and the flat tubes 30, so that heat is exchanged between the air and fluid flowing through the flat tubes 30. Each flat tube 30 is inclined to the direction of the flow of air flowing into the heat exchanger 100 and hence, the air that enters the heat exchanger 100 comes into contact with the upper surface 33 of the flat tube 30, so that the direction of the flow changes.

The first spacer 50*a* and the second spacer 50*b* are provided between the fins 40 of the heat exchanger 100. The standing surface 53*a* of the first spacer 50*a* and the standing surface 53*b* of the second spacer 50*b* are inclined in a direction same as that of the inclination angle θ of the flat tube 30 and hence, the flow of air is not easily blocked. Further, the inclination angle α1 of the standing surface 53*a* of the first spacer 50*a* is smaller than the inclination angle θ of the flat tube 30, so that the direction of the flow of air is gently changed and hence, no possibility remains that ventilation properties are impaired. Further, the inclination angle α2 of the standing surface 53*b* of the second spacer 50*b* is set to a value close to the value of the inclination angle θ of the flat tube 30, so that the flow of air is not blocked in the intermediate region 43 between the flat tubes 30 disposed next to each other.

In the heat exchanger 100*a* of the modification shown in FIG. 9, the first spacer 50*a* is positioned upwind of the flat tube 30. By setting the inclination angle α1 to a small value, ventilation properties are consequently not impaired. In the heat exchanger 100*b* of the modification shown in FIG. 10, the first spacer 50*a* is positioned in the intermediate region 43, and is thus positioned downwind of the first end portion 31 of the flat tube 30. It is consequently preferable to set the inclination angle α1 to a value close to the value of the inclination angle θ of the flat tube 30.

The description has been made above for a state where air flows into the heat exchanger 100 from a direction perpendicular to the first end edge 41 of the fin 40 of the heat exchanger 100. However, there may be also a case where the heat exchanger 100 is disposed and inclined to the direction of gravity, for example. The inclination angle of each of the flat tubes 30, the first spacer 50*a*, and the second spacer 50*b* is only required to be suitably set corresponding to an environment where the heat exchanger 100 is disposed.

Advantageous Effects of Embodiment 1

In the heat exchanger 100, 100*a*, 100*b* according to Embodiment 1, the first spacer 50*a* is inclined in the same direction as the flat tube 30 and hence, it is possible to prevent stagnation, on the first spacer 50*a*, of water flowing from an upper portion of the fin 40. Further, the inclination angle α1 of the standing surface 53*a* of the first spacer 50*a* has the relationship of the mathematical formula of $0<\alpha 1\leq\theta$, so that the flow of air flowing into the heat exchanger 100, 100*a*, 100*b* is not easily blocked. Resistance against frost and drainage properties of the heat exchanger 100, 100*a*, 100*b* are consequently enhanced while heat exchange performance is maintained. Further, even in the case where the transverse axis of the flat tube 30 is shorter than the interval between the arranged fins 40, it is also possible to appropriately ensure a gap between the fins 40 by the first spacer 50*a*.

Embodiment 2

A heat exchanger 200 according to Embodiment 2 is a heat exchanger obtained by changing the disposition of the first spacer 50*a* from that in the heat exchanger 100 according to Embodiment 1. The description of the heat exchanger 200 according to Embodiment 2 is made below mainly for points different from Embodiment 1. In the drawings, portions of the heat exchanger 200 according to Embodiment 2 having the same functions as those in Embodiment 1 are given the same reference signs as used in the drawings for describing Embodiment 1.

Figure 13:
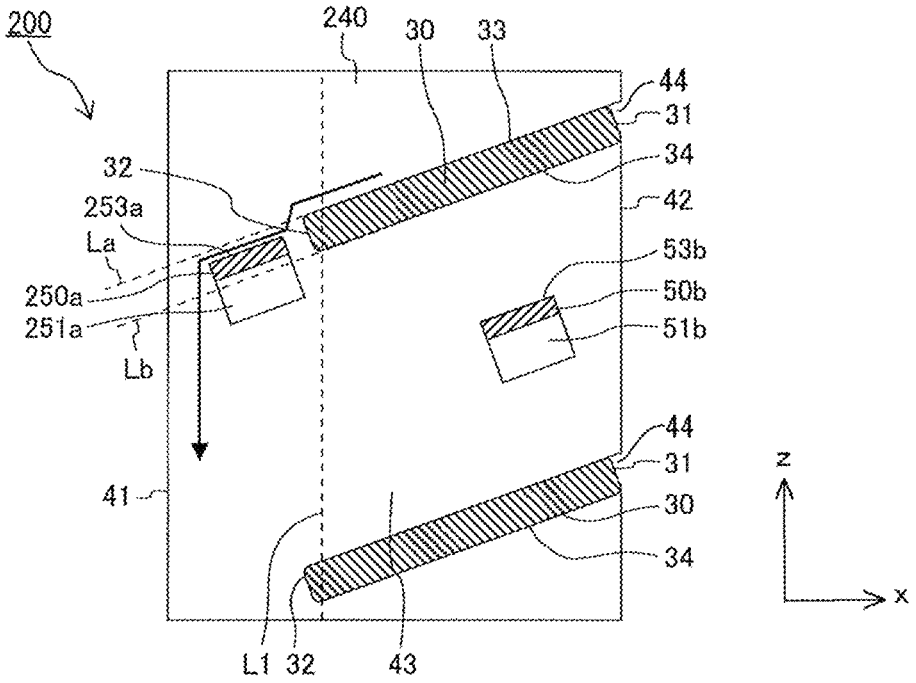
FIG. 13 is an explanatory view of the sectional structure of a heat exchanger according to Embodiment 2.

FIG. 13 is an explanatory view of the sectional structure of the heat exchanger 200 according to Embodiment 2. FIG. 13 shows a section perpendicular to the pipe axes of the flat tubes 30 shown in FIG. 1. A first spacer 250*a* is provided to a fin 240 of the heat exchanger 200 and positioned close to a first end edge 241. The first spacer 250*a* is disposed and positioned closer to the first end edge 41 than the first imaginary line L1 connecting the first end portions 31 of the flat tubes 30 aligned in the up-and-down direction. Further, the first spacer 250*a* is positioned between an imaginary line La and an imaginary line Lb. The imaginary line La extends in the longitudinal direction of the sectional shape of the flat tube 30 from the upper surface 33 of the flat tube 30. The imaginary line Lb extends in the longitudinal direction of the section of the flat tube 30 from a lower surface 34 of the flat tube 30. In other words, the first spacer 250*a* is disposed in a region obtained by projecting the flat tube 30 in a direction along the longitudinal direction of the section of the flat tube 30.

The first spacer 250*a* and the first end portion 31 of the flat tube 30 are positioned with a predetermined separation. The cut-out portion 44 is formed in the fin 240 at a portion where the flat tube 30 is disposed and hence, the cut-out portion 44 and the first spacer 250*a* are formed to be spaced apart from each other. In Embodiment 2, the inclination angle $\alpha 1$ of the first spacer 250*a* is set to a value substantially equal to the value of the inclination angle $\theta$ of the flat tube 30. However, the inclination angle $\alpha 1$ is not limited to the above, and any value within the mathematical formula of $0<\alpha 1\leq\theta$ may be used.

Advantageous Effects of Embodiment 2

In the heat exchanger 200 according to Embodiment 2, the first spacer 250*a* is disposed in the vicinity of the extension of the upper surface 33 of the flat tube 30 where water easily stagnates. When water on the upper surface 33 of the flat tube 30 reaches the first end portion 31, the water is consequently guided toward the first spacer 250*a* because of capillarity, and is drained from the flat tube 30. Further, the first spacer 250*a* is inclined by the inclination angle $\alpha 1$, so that the water guided from the flat tube 30 is easily drained also from the first spacer 250*a*. In the heat exchanger 200, water on the upper surface 33 and the lower surface 34 of the flat tube 30 is easily guided toward the first end edge 41 by the first spacer 250*a*. Compared with the heat exchanger 100, 100*a*, 100*b* according to Embodiment 1, the heat exchanger 200 therefore has an advantageous effect that the amount of water remaining on the upper surface 33 and the lower surface 34 of the flat tube 30 easily reduces. Further, the first spacer 250*a* is disposed in a region obtained by projecting the flat tube 30 in the longitudinal direction of the section of the flat tube 30, and is formed in such a manner that the flow of air passing across the first end edge 41 of the fin 240 is caused to flow to the upper surface 33 of the flat tube 30. No possibility consequently remains that ventilation properties of the heat exchanger 200 are impaired.

As long as at least one of the first spacer 250*a* and an opening port 251*a* is disposed between the imaginary line La and the imaginary line Lb, the heat exchanger 200 according to Embodiment 2 obtains an advantageous effect of draining water on the upper surface 33 of the flat tube 30.

Embodiment 3

A heat exchanger 300 according to Embodiment 3 is a heat exchanger obtained by changing the disposition of the second spacer 50*b* from that in the heat exchanger 100 according to Embodiment 1. The description of the heat exchanger 300 according to Embodiment 3 is made below mainly for points different from Embodiment 1. In the drawings, portions of the heat exchanger 300 according to Embodiment 3 having the same functions as those in Embodiment 1 are given the same reference signs as used in the drawings for describing Embodiment 1.

Figure 14:
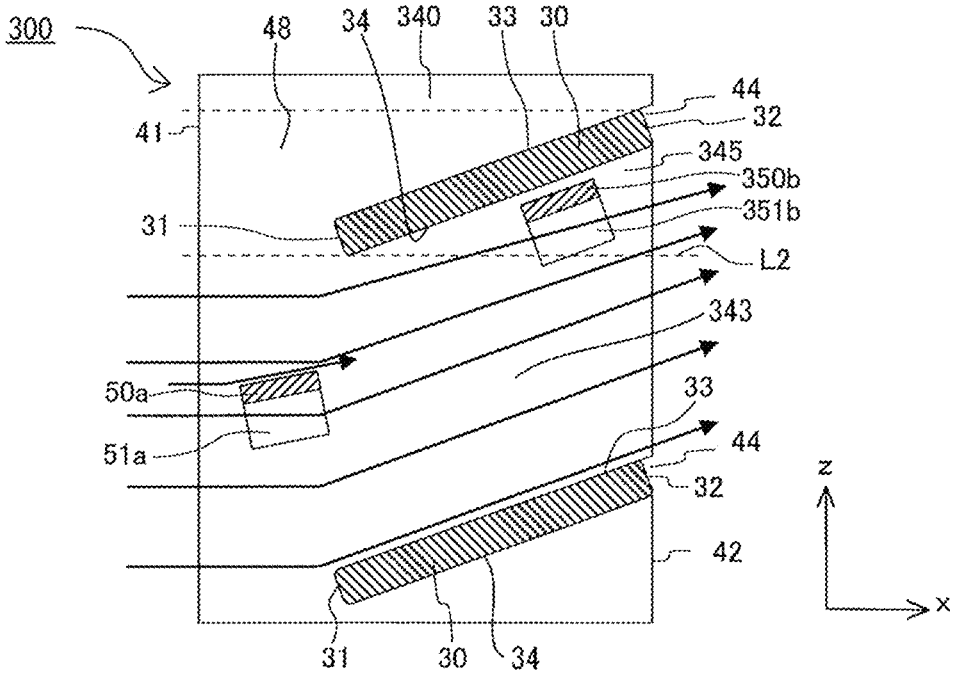
FIG. 14 is an explanatory view of the sectional structure of a heat exchanger according to Embodiment 3.

FIG. 14 is an explanatory view of the sectional structure of the heat exchanger 300 according to Embodiment 3. FIG. 14 shows a section perpendicular to the pipe axes of the flat tubes 30 shown in FIG. 1. A second spacer 350*b* is formed on a fin 340 of the heat exchanger 300 in an intermediate region 343 that is a region between the cut-out portions 44 into which the flat tubes 30 are inserted. The flat tubes 30 of the heat exchanger 300 are inclined and hence, when air flows into the heat exchanger 300 across the first end edge 41 of the fin 340 as shown in FIG. 12, air passes through the heat exchanger 300 along the flat tubes 30.

When the second spacer 350*b* is viewed from the first end edge 41, that is, when the second spacer 350*b* is viewed in a direction along which air flows into the heat exchanger 300 in FIG. 14, the second spacer 350*b* is disposed in a region shielded by the flat tube 30. In other words, the second spacer 350*b* is disposed in a shielded region 345 disposed behind the flat tube 30 as the second spacer 350*b* is viewed from the first end edge 41 of the fin 340. Still further, in the intermediate region 343 between two cut-out portions 44, the second spacer 350*b* is disposed in the shielded region 345 that is a region between a second imaginary line L2 and the lower surface 34 of the flat tube 30, and the second imaginary line L2 is drawn horizontal to the width direction of the fin 340 from the lower end of the first end portion 31 of the flat tube 30.

In the heat exchanger 300 according to Embodiment 3, the first spacer 50*a* may be disposed in the same manner as the heat exchanger 100, 100*a*, 100*b* of Embodiment 1, or the first spacer 250*a* may be disposed in the same manner as the heat exchanger 200 of Embodiment 2. Alternatively, the heat exchanger 300 may have a configuration in which only the second spacer 350*b* is provided to the fin 340.

Advantageous Effects of Embodiment 3

In the heat exchanger 300 according to Embodiment 3, the second spacer 350*b* is disposed in the shielded region 345, so that intervals between the fins 340 are ensured without blocking the flow of air passing through the heat exchanger 300. The shielded region 345 below the flat tube 30 is a portion shielded by the flat tube 30 when the shielded region 345 is viewed from the upper stream of the flow of air, and is a region where the flow of air stagnates. Most of the flow of air passing through between the fins 340 passes through a region below the shielded region 345 and hence, the second spacer 350*b* does not significantly affect the flow of air passing through between the fins 340. The heat exchanger 300 therefore maintains the intervals between the fins 340 with high accuracy while ventilation properties are ensured. Further, in the same manner as Embodiment 1 and Embodiment 2, as the second spacer 350*b* is inclined in the same direction as the flat tube 30, drainage properties are high. In Embodiment 3, the inclination angle α2 of the second spacer 350*b* may be set to be greater than the inclination angle θ of the flat tube 30. The reason is as follows. In the case where air flows into the heat exchanger 300 in a direction perpendicular to the longitudinal direction of the fin 340 as shown in FIG. 14, the shielded region 345 where the second spacer 350*b* is disposed is a region where the flow of air stagnates and hence, ventilation properties of the heat exchanger 300 are not significantly affected.

REFERENCE SIGNS LIST

1 refrigeration cycle apparatus 2 fan 3 compressor 4 four-way valve 5 outdoor heat exchanger 6 expansion device 7 indoor heat exchanger 8 outdoor unit 9 indoor unit 10 (first) heat exchange part 20 (second) heat exchange part 30 flat tube 31 first end portion 32 second end portion 33 upper surface 34 lower surface 40 fin 41 first end edge 42 second end edge 43 intermediate region 44 cut-out portion

48 plate surface 50 spacer 50*a* first spacer 50*b* second spacer 51 opening port 52 contact portion 53 standing surface 53*a* standing surface 53*b* standing surface 60 header 61 header 62 header 90 refrigerant pipe 91 refrigerant pipe 92 refrigerant pipe 100 heat exchanger 100*a* heat exchanger 100*b* heat exchanger 100*c* heat exchanger 140 fin 148*a* plate surface 148*b* plate surface 150 spacer 150*a* spacer 150*b* spacer 151 opening port 153 standing surface 153*a* standing surface 153*b* standing surface 180 dotted line

200 heat exchanger 240 fin 241 first end edge 250*a* first spacer 251*a* opening port 300 heat exchanger 340 fin 343 intermediate region 345 shielded region 350*b* second spacer 1040 fin 1050*a* spacer 1050*b* spacer 1051*a* opening port 1051*b* opening port 1053*a* standing surface 1053*b* standing surface 1100 heat exchanger C arrow L1 imaginary line L2 imaginary line L3 imaginary line La imaginary line Lb imaginary line h drainage region α1 inclination angle α2 inclination angle θ inclination angle

The invention claimed is:

1. A heat exchanger, comprising:

a flat tube; and a plurality of fins each comprising a plate having a plate surface extending in a longitudinal direction and in a width direction orthogonal to the longitudinal direction, the plate surface intersecting a pipe axis of the flat tube, the plurality of fins being arranged at an interval from one another, the plurality of fins each having a first spacer formed in the plate and maintaining the interval, the flat tube having a longitudinal axis of a section perpendicular to the pipe axis, the longitudinal axis being inclined to the width direction by an inclination angle θ, the first spacer having a standing surface extending in a direction intersecting the plate surface, the standing surface being inclined in a direction same as that of the inclination angle θ.

2. The heat exchanger of claim 1, wherein the plurality of fins each have a first end edge that is one end edge in the width direction, and a second end edge that is an other end edge in the width direction, a cut-out portion is formed at the second end edge, the flat tube is inserted into the cut-out portion, a first end portion of the flat tube is positioned lower than is a second end portion of the flat tube and, the first end portion of the flat tube is positioned closer to the first end edge in the width direction than is the second end portion of the flat tube positioned closer to the second end edge in the width direction than is the first end portion of the flat tube.

3. The heat exchanger of claim 2, wherein the flat tube is either one of a first flat tube and a second flat tube disposed next to each other in the longitudinal direction of each of the plurality of fins, the plurality of fins each have an intermediate region formed between the cut-out portion into which the first flat tube is inserted and the cut-out portion into which the second flat tube is inserted, and the first spacer is disposed closer to the first end edge than the intermediate region.

4. The heat exchanger of claim 3, wherein the plurality of fins each have a first opening port formed in the plate surface by causing the first spacer to be erected, and the first opening port is positioned below the first spacer.

5. The heat exchanger of claim 4, wherein at least one of the first spacer and the first opening port is disposed in a region obtained by projecting the flat tube in a direction along the longitudinal axis.

6. The heat exchanger of claim 2, wherein the flat tube is either one of a first flat tube and a second flat tube disposed next to each other in the longitudinal direction of each of the plurality of fins, the plurality of fins each have an intermediate region formed between the cut-out portion into which the first flat tube is inserted and the cut-out portion into which the second flat tube is inserted, and the first spacer is disposed in the intermediate region.

7. The heat exchanger of claim 6, wherein the first spacer is disposed on a first imaginary line connecting a first end portion of the first flat tube and a first end portion of the second flat tube that are positioned close to the first end edge.

8. The heat exchanger of claim 7, wherein the first spacer is disposed closer to the flat tube than a second imaginary line extending in the width direction from the first end portion out of end portions of the flat tube, the first end portion being positioned close to the first end edge.

9. The heat exchanger of claim 6, wherein the plurality of fins each have a first opening port formed in the plate surface by causing the first spacer to be erected, and the first opening port is positioned below the first spacer.

10. The heat exchanger of claim 1, wherein an inclination angle α of the standing surface of the first spacer is less than or equal to the inclination angle θ of the flat tube.

11. The heat exchanger of claim 9, wherein an inclination angle α of the standing surface of the first spacer is greater than the inclination angle θ of the flat tube.

12. The heat exchanger of claim 3, wherein the plurality of fins each further include a second spacer positioned closer to the second end edge than is the first spacer and maintaining the interval, the second spacer has a second standing surface extending and intersecting the plate surface, and the second standing surface is inclined in the direction same as that of the inclination angle θ of the flat tube.

13. The heat exchanger of claim 12, wherein the second spacer is disposed in the intermediate region.

14. The heat exchanger of claim 12, wherein the second spacer is disposed closer to the flat tube than a second imaginary line extending in the width direction of each of the plurality of fins from each of the first end portion of the first flat tube and the first end portion of the second flat tube that are positioned close to the first end edge.

15. The heat exchanger of claim 12, wherein a second opening port is formed in the plate surface by causing the second spacer to be erected, and the second opening port is positioned below the second spacer.

16. A heat exchanger unit comprising:

the heat exchanger of claim 1; and a fan configured to send air to the heat exchanger.

17. A refrigeration cycle apparatus comprising the heat exchanger unit of claim 16.

* * * * *